US010669703B2

(12) United States Patent
Zoller

(10) Patent No.: US 10,669,703 B2
(45) Date of Patent: Jun. 2, 2020

(54) SANITARY INSERT UNIT

(71) Applicant: NEOPERL GMBH, Mullheim (DE)

(72) Inventor: Uwe Zoller, Teningen (DE)

(73) Assignee: Neoperl GmbH, Mulheim (DE)

( * ) Notice: Subject to any disclaimer, the term of this patent is extended or adjusted under 35 U.S.C. 154(b) by 120 days.

(21) Appl. No.: 14/878,199

(22) Filed: Oct. 8, 2015

(65) Prior Publication Data

US 2016/0024769 A1 Jan. 28, 2016

Related U.S. Application Data

(63) Continuation-in-part of application No. 13/190,402, filed on Jul. 25, 2011, which is a continuation-in-part of application No. 11/863,601, filed on Sep. 28, 2007, now abandoned, which is a continuation of application No. 10/547,204, filed as application No. PCT/EP2004/002504 on Mar. 11, 2004, now abandoned.

(30) Foreign Application Priority Data

Mar. 21, 2003 (DE) ..... 103 12 854

(51) Int. Cl.

| | |
|---|---|
| ***E03C 1/084*** | (2006.01) |
| ***E03C 1/08*** | (2006.01) |
| *E03C 1/02* | (2006.01) |

(52) U.S. Cl.

CPC ..... *E03C 1/084* (2013.01); *E03C 1/08* (2013.01); *E03C 2001/026* (2013.01)

(58) Field of Classification Search

CPC ..... E03C 1/084; E03C 1/08; E03C 2001/026; G05D 7/012

USPC ..... 239/428.5

See application file for complete search history.

(56) References Cited

U.S. PATENT DOCUMENTS

| | | | | |
|---|---|---|---|---|
| 2,777,464 A * | 1/1957 | Mosely | G05D 7/012 137/516.13 |
| 3,104,819 A | 9/1963 | Aghnides | |
| 3,216,451 A | 11/1965 | Smallpeice | |
| 4,000,857 A | 1/1977 | Moen | |
| 4,313,564 A | 2/1982 | Shames et al. | |

(Continued)

FOREIGN PATENT DOCUMENTS

| | | |
|---|---|---|
| DE | 34 40 883 A1 | 5/1986 |
| DE | 36 42 356 A1 | 6/1988 |

(Continued)

*Primary Examiner* — Jason J Boeckmann

(74) *Attorney, Agent, or Firm* — Robinson & Cole LLP; John L. Cordani

(57) ABSTRACT

The present disclosure is directed to a sanitary insert unit, configured for insertion into a discharge fitting. The insert unit includes an upstream sieve connected to a throughflow regulator. The throughflow regulator includes a control gap and a throttle body that deforms under pressure to regulate throughflow by varying an opening size of the control gap. The sieve and throughflow regulator are arranged upstream of a jet diffusor which includes a plurality of radial openings. The sieve, throughflow regulator and jet diffusor are arranged to be, at least partially, received within a housing. The ratio of the overall height of the insert unit to the height of the height of the assembled sieve and throughflow regulator is approximately 2.7:1.

8 Claims, 7 Drawing Sheets

(56) References Cited

U.S. PATENT DOCUMENTS

| | | | | |
|---|---|---|---|---|
| 4,470,546 | A | 9/1984 | Wildfang | |
| 4,562,960 | A | 1/1986 | Marty et al. | |
| 4,657,186 | A | 4/1987 | Shapiro | |
| 4,730,786 | A | 3/1988 | Nelson | |
| 4,976,283 | A * | 12/1990 | Wildfang | F16K 17/34 137/504 |
| 5,769,326 | A * | 6/1998 | Muchenberger | E03C 1/08 239/428.5 |
| 6,695,011 | B2 | 2/2004 | Sochtig | |
| 6,902,123 | B2 * | 6/2005 | Grether | E03C 1/084 239/428.5 |
| 2002/0084353 | A1 | 7/2002 | Griffin et al. | |
| 2003/0141384 | A1 | 7/2003 | Grether et al. | |
| 2006/0273203 | A1 * | 12/2006 | Denzler | E03C 1/08 239/428.5 |

FOREIGN PATENT DOCUMENTS

| | | | | |
|---|---|---|---|---|
| DE | 38 35 559 | A1 | 4/1990 | |
| WO | 01/96673 | A1 | 12/2001 | |
| WO | WO 0196673 | A1 * | 12/2001 | E03C 1/084 |

* cited by examiner

SANITARY INSERT UNIT

CROSS-REFERENCE TO RELATED APPLICATIONS

This application is a continuation-in-part of U.S. application Ser. No. 13/190,402, filed Jul. 25, 2011, which is a continuation-in-part of U.S. application Ser. No. 11/863,601, filed Sep. 28, 2007, now abandoned, which is continuation of U.S. application Ser. No. 10/547,204, filed Aug. 26, 2005, now abandoned, which is a 371 National Phase of PCT/EP2004/002504, filed Mar. 11, 2004, the entire contents of all of which are incorporated by reference herein as if fully set forth.

BACKGROUND

The invention relates to a sanitary insert unit, which can be inserted into a discharge fitting, comprising an essentially conical-shaped upstream sieve with a downstream throughflow regulator and a jet regulator located further downstream in the direction of the flow.

Sanitary insert units of the type mentioned at the outset have been known in various embodiments. Such insert units are regularly inserted into a discharge mouthpiece, which is mounted in a detachable manner in a sanitary discharge fitting. With the aid of such insert units, a homogenous, soft, and non-splashing water jet is formed.

Such insert units, comprising an upstream throughflow regulator and a downstream jet regulator, can result in mounting problems due to their construction size. In particular, the retrofitting into such discharge fittings is problematic, which had previously been operated with an insert unit comprising no throughflow regulators but a jet regulator only, because the latter insert unit has a lower construction height than the insert unit with a throughflow regulator.

SUMMARY

The present disclosure is directed to a sanitary insert unit, configured for insertion into a discharge fitting. The insert unit includes an upstream sieve connected to a throughflow regulator. The throughflow regulator includes a control gap and a throttle body that deforms under pressure to regulate throughflow by varying an opening size of the control gap. The sieve and throughflow regulator are arranged upstream of a jet diffusor which includes a plurality of radial openings. The sieve, throughflow regulator and jet diffusor are arranged to be, at least partially, received within a housing. The ratio of the overall height of the insert unit to the height of the height of the assembled sieve and throughflow regulator is approximately 2.7:1.

BRIEF DESCRIPTION OF THE DRAWINGS

An exemplary embodiment of the insert unit according to the invention is explained in greater detail in the following drawings where.

DETAILED DESCRIPTION OF THE PREFERRED EMBODIMENTS

Figure 1:
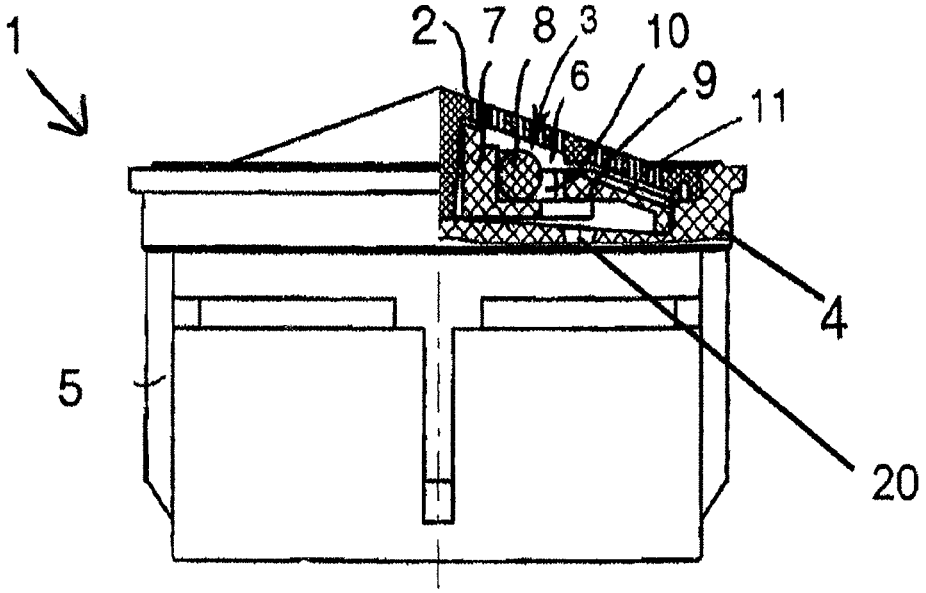
FIG. 1 is a side view of an insert unit according to the invention, partially in cross-section.

Thus, the object is to provide a jet regulator or sanitary insert unit of the type mentioned at the outset, in which the mounting problems based on the construction height are avoided even in environments with limited space.

The object is attained according to the invention in particular in that the throughflow regulator is essentially arranged within the interior space of the insert unit limited at its top by the upstream sieve.

Thus, the previously unused interior space below the upstream sieve of insert units known is practically used for the throughflow regulator, so that the construction height of the insert unit according to the invention with the throughflow regulator requires little or no increase in reference to the construction height of a conventional insert unit.

In this way, a hundred per cent geometrical compatibility of two such insert units is realized so that any mutual exchange of the insert units or the optional retrofitting of the throughflow regulator is possible without any problems.

The insertion of the throughflow regulator into the interior space limited by the upstream sieve can occur in a particularly efficient manner, when the throughflow regulator is provided with a cross-sectional profile essentially shaped corresponding to the profile of the upstream sieve.

Alternatively, the throughflow regulator and the upstream sieve can be a modular unit that can be inserted into a housing of the jet regulator.

Over time, the upstream sieve can become clogged by contaminants or calcium deposits. In order to ensure sufficient water flow even in upstream sieves partially clogged in their central area it is advantageous for the throughflow regulator to be provided with a sloping surface rising radially upward at an exterior, in particular circular edge region, which leads to a throughflow opening connected to a control gap or the like, provided with the jet regulator, and for the rising sloping surface and the upstream sieve to be distanced from one another.

This way, inflowing water can be fed from the exterior region of the upstream sieve via the rising sloping surface to the throughflow regulator and, subsequently, to the jet regulator. This ensures the functionality of the insert unit according to the invention even with a partially clogged upstream sieve.

In order to achieve a defined flow of water to the throughflow regulator via the rising sloping surface and to avoid turbulence in the circumferential direction, it is useful for the rising sloping surface to be provided on its upper side with approximately radially aligned grooves to form individual inflow channels. Through the bundled water flow in the feeding channels, the inflow speed can be increased at the throughflow regulator, and subsequently at the jet regulator as well, so that the functionality of the insert unit is improved.

It is advantageous for the bars located between the grooves to end close to or at the interior side of the upstream sieve and to serve as support elements for said upstream sieve. This way, the bars form supports for the upstream sieve so that the stability of the arrangement is improved and an undesired deformation of the upstream sieve, for example, by excessive pressure of the inflowing water, can be avoided.

In order to enable steady water influx it is useful for the bars of the rising sloping surface to be distanced from one another in regular intervals in the circumferential direction.

One preferred embodiment of the insert unit according to the invention includes the throughflow regulator being provided with a central core region, which is surrounded by a circular throttle body, and that between the throttle body and the rising sloping surface a control gap is formed, with the cross-section of its opening being adjustable by the throttle body deforming under the pressure difference developing by the throughflow.

Figure 3:
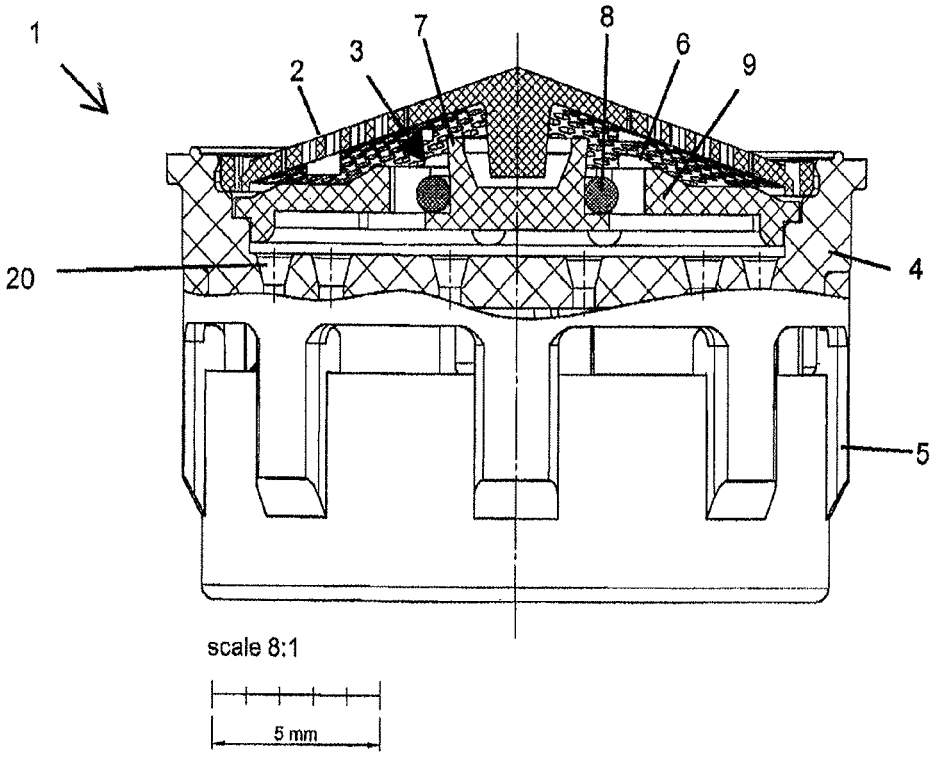
FIG. 3 is a side view, shown to scale, of an insert unit according to the invention, partially in cross-section.
Figure 4:
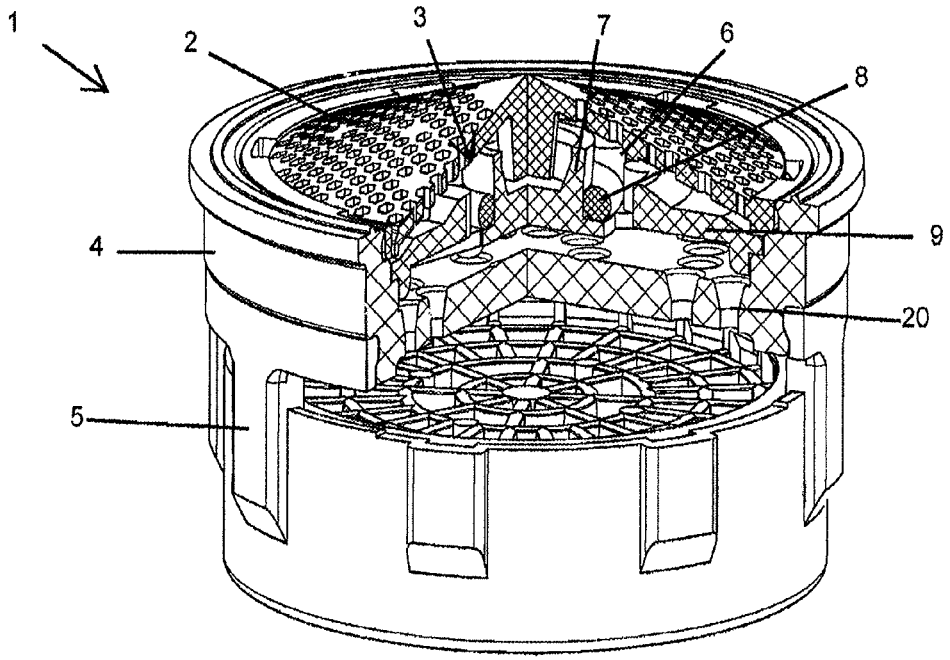
FIG. 4 is a perspective view of an insert unit according to the invention, partially in cross-section.

As shown in FIGS. 1, 3 and 4, a jet regulator or sanitary insert unit, marked 1 in its entirety, is provided with an upstream sieve 2, a throughflow regulator 3, and a jet fractionating plate 4, detachably connected to one another via its housing 5.

FIGS. 1 and 3 show a side view of the insert unit 1 partially in a cross-section with FIG. 4 being a perspective view. Below the upstream sieve 2, formed essentially cone-shaped, an interior space 6 is formed, in which the throughflow regulator 3 is arranged. The throughflow regulator 3 is provided with a central core region 7, which is surrounded by a circular throttle body 8. Between the throttle body 8 and a radially, inwardly rising sloped surface 9 a control gap 10 is formed in the exterior edge region of the throughflow regulator 3, which is in throughflowing connection to the jet fractionating plate 4, which comprises a plurality of axial openings 20 in a throughflow direction located therebelow. The upstream sieve 2 is connected to the jet fractionating plate 4, for example by a snap fit. As shown in FIGS. 1, 3 and 4, the throughflow regulator 3 is arranged in the interior space 6 in such a way that the sieve 2 keeps it in place in the interior space 6.

The central core region 7, the throttle body 8, and the rising sloping surface 9 are sized such that the cross-sectional profile of the throughflow regulator 3 is substantially form-fitting to the cross-sectional profile of the upstream sieve 2, with the rising sloping surface 9 and the upstream sieve 2 being distanced from one another. As discernable from FIG. 3, which is shown to scale, the ratio of the overall height of the insert unit 1 to the height of the interior space 6 is approximately 3:1. This ratio, which can also be varied, allows a throughflow regulator 3 to be used in an insert unit that was previously unable to accommodate throughflow regulator due to height restrictions. Moreover, the housing 5 can maintain its height, which provides aeration of water flowing through the insert 1, without requiring housings having different heights when incorporating a throughflow regulator.

Due to the arrangement of the throughflow regulator 3 inside the interior space 6 formed below the upstream sieve 2 an insert unit 1 results with, in reference to conventional insert units, a reduced construction height and/or with the ability to realize a construction height for an insert unit housing a throughflow unit, which previously was only possible for insert units without any throughflow regulators. This is particularly evidenced by FIG. 3, which is to scale, and generally shows that the overall height of the insert unit being generally 3 times the maximum height of the interior space 6. Thus, the insert unit 1 according to the invention can be easily integrated in environments, in which previously known jet regulators without any throughflow regulators had been used or which are provided with limited space available.

Figure 2:
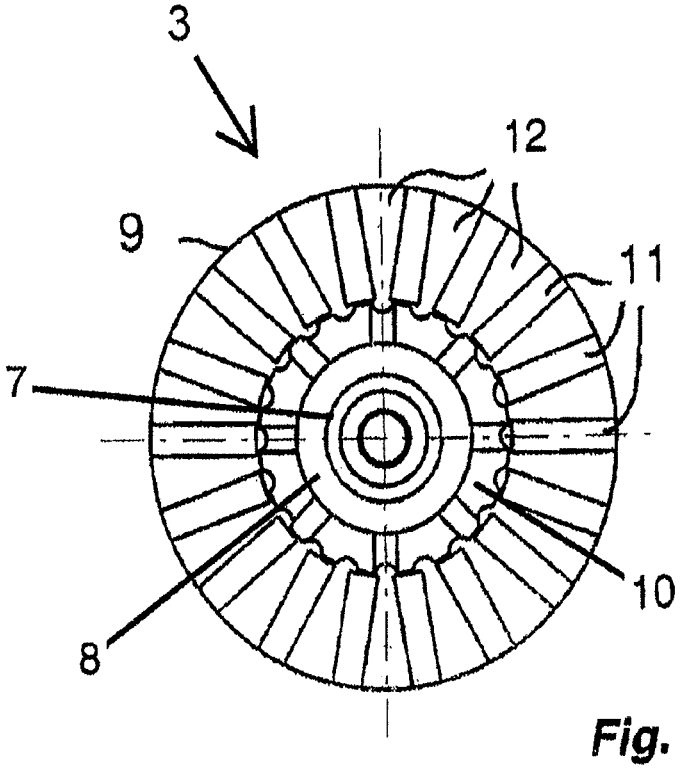
FIG. 2 is a top view of the throughflow regulator of an insert unit according to the invention.

As particularly discernible in FIG. 2, the rising sloped surface 9 is provided at its upper side with rinsing grooves or the like 11, extending radially and equally spaced apart from one another, in order to form individual influx channels. These influx channels allow a controlled incoming flow of water, which enters the throughflow regulator 3 through the area of the upstream sieve 2 above rising sloping surface 9, towards the control gap 10. This way, even in the case of a sectional clogging of the upstream sieve 2 in the central region, for example by contaminants in the inflowing water or by calcium deposit, sufficient water flow from the exterior region is ensured into the control gap 10 and subsequently into jet fractionating plate 4.

The bars or protrusions 12 positioned between the grooves 11 and limiting them end in proximity to the interior side of the upstream sieve 2. This way, they can serve as support elements for the upstream sieve 2, in order to improve the stability of the insert unit 1 and to prevent an undesired deformation of the upstream sieve 2 into the interior space 6, for example by excessive pressure of the inflowing water or by the handling during the mounting process of the insert unit 1.

Figure 5:
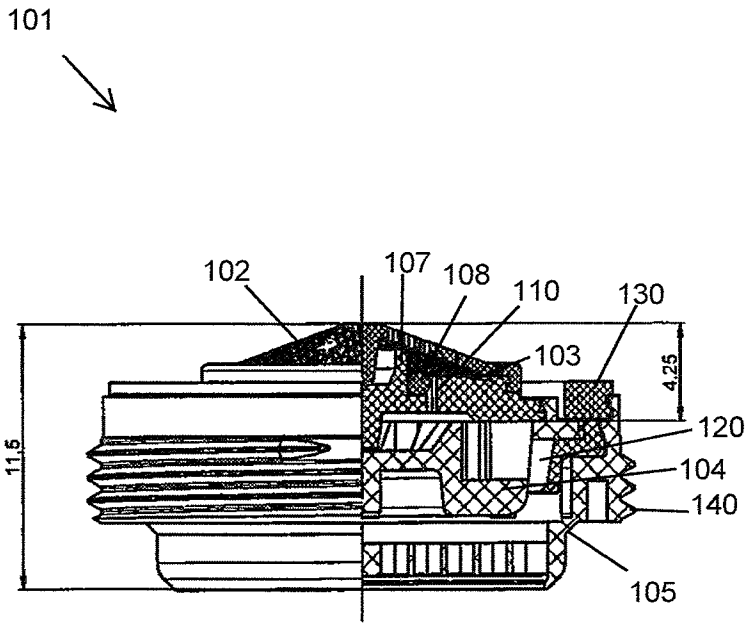
FIG. 5 is a side view, shown to scale, of an insert unit according to a second embodiment of the invention, partially in cross-section.

The jet regulator 101 of the embodiment shown in FIG. 5 includes an upstream sieve 102 and throughflow regulator 103 provided with a central core region 107, which is surrounded by a circular throttle body 108. Adjacent the throttle body 108 is a control gap 110 is formed in the exterior edge region of the throughflow regulator 103, which is in throughflowing connection to a jet diffusor 104, which comprises a plurality of radial openings 120 in a throughflow direction. The upstream sieve 102 is connected to the throughflow regulator 103, which is in turn connected to the jet diffusor 104, for example by a snap fit.

As is discernable from FIG. 5, which is shown to scale, the ratio of the overall height of the insert unit 101 to the height of the sieve attached to the throughflow regulator is approximately 3:1, preferably 2.7:1. This ratio, which can also be varied, allows a throughflow regulator 103 to be used in an insert unit 101 that was previously unable to accommodate throughflow regulator due to height restrictions. The housing 105 includes a threaded portion 140 which allows the insert unit 101 to be installed directly into the opening of an armature outlet, thereby allowing for a greater number of applications without dimensional limitations due to height requirements.

Figure 6:
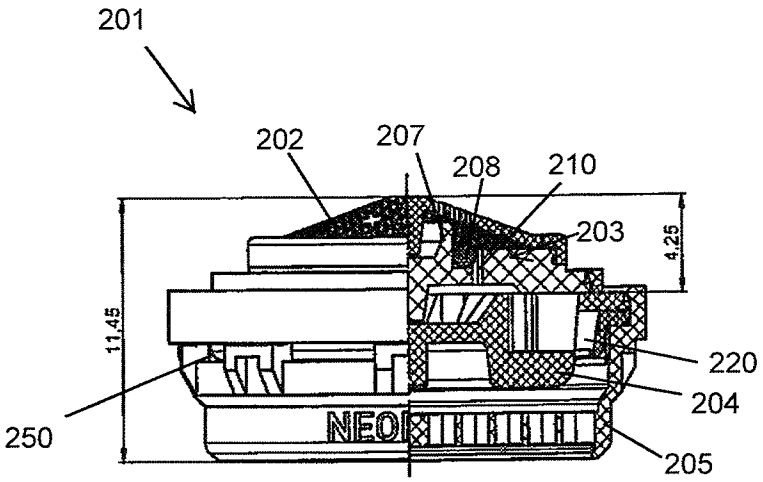
FIG. 6 is a side view, shown to scale, of an insert unit according to a third embodiment of the invention, partially in cross-section.

We now turn to FIG. 6, which is shown to scale and depicts an aerated insert unit 201. As in the embodiment of FIG. 5, the insert unit 201 includes an upstream sieve 202 and throughflow regulator 203 provided with a central core region 207, which is surrounded by a circular throttle body 208. Adjacent the throttle body 208 is a control gap 210 is formed in the exterior edge region of the throughflow regulator 203, which is in throughflowing connection to a jet diffusor 204, which comprises a plurality of radial openings 220 in a throughflow direction. The housing 205 of the insert unit 201 of FIG. 6 includes aeration slots 250, which draw air into the insert unit 201 to mix with the water flowing through the radial openings 220 before exiting the housing at the downstream end 215.

Previously, it was believed that the height of the chamber where the water exiting was mixed with the drawn in air had to be higher than the dimensions of the present housing 205. However, it was discovered that the approximately 2.69:1 ratio of the overall height of the insert unit 201 to the height of the sieve attached to the throughflow regulator provided a sufficient amount of air to be drawn into the housing 205 to mix with the water flowing through the radial openings 220 to provide a useful aerated stream.

Figure 7:
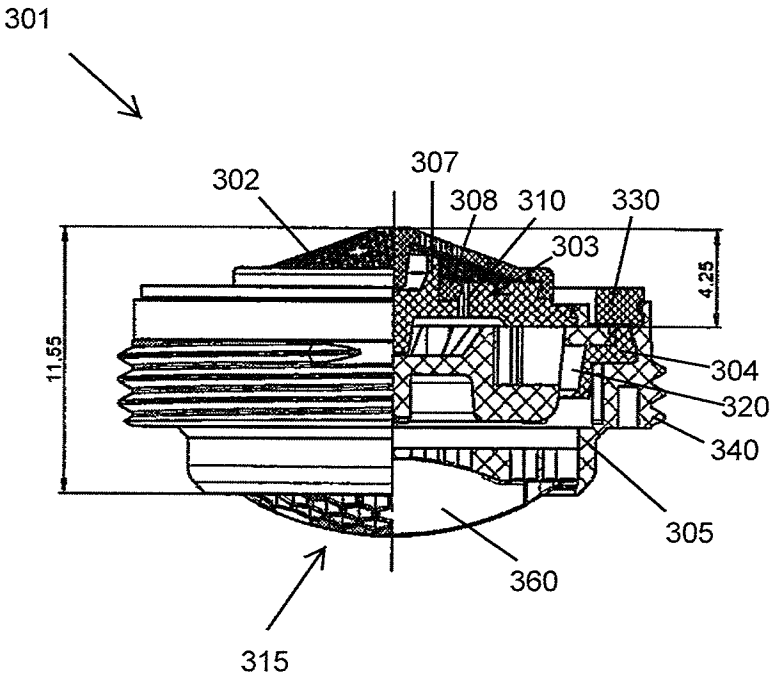
FIG. 7 is a side view, shown to scale, of an insert unit according to a fourth embodiment of the invention, partially in cross-section.

The insert unit 301 of FIG. 7 is similar to the embodiment of FIG. 5 where the housing 305 includes a threaded portion 340. The Insert unit 301 includes an upstream sieve 302 and throughflow regulator 303 provided with a central core region 307, which is surrounded by a circular throttle body 308. As in FIGS. 5 and 6, there is a control gap 310, adjacent the throttle body 308, which is formed in the exterior edge region of the throughflow regulator 303 and which is in throughflowing connection to a jet diffusor 304, which comprises a plurality of radial openings 320.

The insert unit 301 of FIG. 7 also includes a tool engagement portion 360, located at the downstream end face 315 of the insert unit 301. The tool engagement portion 360 is configured to receive a tool to allow the insert unit 301 to be screwed into an outlet of an armature. The tool engagement portion 360 is depicted here as a single slot, however it should be understood that the tool engagement portion 360 can have more than one slot.

A screwdriver, for example, may be inserted into the slot as the turning tool. However, a preferred development according to the invention provides that the at least one slot is designed for inserting a partial region of a turning tool taking the form of a coin or for inserting a coin serving as the turning tool. A partial region of a turning tool taking the form of a coin or a coin used as a turning tool offers the advantage that the comparatively large flat sides of this turning tool are a good indication of the relative position of the housing, the housing end face and the water outlet. In particular, a coin is generally always available as a turning tool.

To be able to center the coin or the partial region of a turning tool in the form of a coin quickly and easily in the position for use in the slot, it is advantageous if the at least one slot has a circular-segmental cross section in the direction of insertion.

To be able to place the turning tool quickly on the housing end face, it is expedient if at least two slots crossing each other are provided on the housing end face. In this respect, a preferred embodiment according to the invention provides that the slots are arranged crosswise in relation to each other and that the crossing point of the crossing slots is provided approximately midway along the longitudinal extent of at least one slot.

The at least one slot may be designed as a slot-like clearance in the housing end face. However, a preferred embodiment according to the invention that is distinguished by a high degree of stability of the housing end face even in the region of the slot provides that the at least one slot has a groove base which is of a closed design or of an open or liquid-permeable design—for example as a result of a perforated or grid structure forming the groove base.

Figure 8:
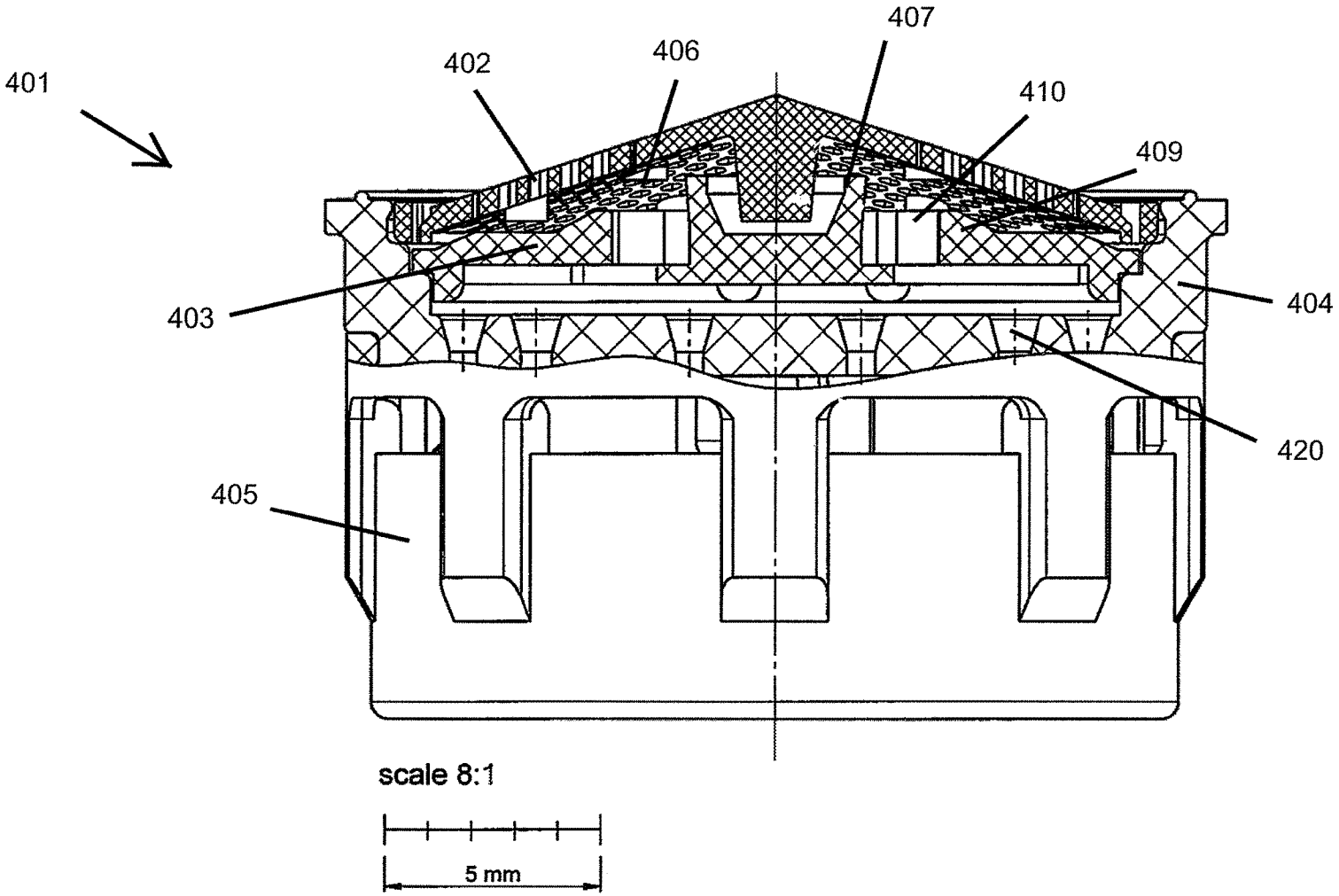
FIG. 8 is a side view, shown to scale, of an insert unit according to a fifth embodiment of the invention, partially in cross-section.

FIG. 8 shows a side view of the insert unit 401 partially in a cross-section of a fifth embodiment. Below the upstream sieve 402, formed essentially cone-shaped, an interior space 406 is formed, in which the throughflow restrictor 403 is arranged. The throughflow restrictor 403 is provided with a central core region 407. Unlike the embodiments of FIGS. 1-4, the throughflow restrictor 403 is configured without a throttle body to restrict throughflow. The control gap 410 being sized according to the desired restriction of the throughflow. The insert unit 401 can be configured to a certain flow restriction by selection of an appropriately sized throughflow restrictor 403 depending on the gap size. The control gap 410 is formed in the interior edge region of the throughflow restrictor 403, which is in throughflowing connection to the jet fractionating plate 404, which comprises a plurality of axial openings 420 in a throughflow direction located therebelow. The upstream sieve 402 is connected to the jet fractionating plate 404, for example by a snap fit. The throughflow restrictor 403 is arranged in the interior space 406 in such a way that the sieve 402 keeps it in place in the interior space 406.

The central core region 407 and a rising sloping surface of the throughflow restrictor 403 are sized such that the cross-sectional profile of the throughflow restrictor 403 is substantially form-fitting to the cross-sectional profile of the upstream sieve 402, with the rising sloping surface 409 and the upstream sieve 402 being distanced from one another. As discernable from FIG. 8, which is shown to scale, the ratio of the overall height of the insert unit 401 to the height of the interior space 406 is approximately 3:1. This ratio, which can also be varied, allows a throughflow restrictor 403 to be used in an insert unit that was previously unable to accommodate throughflow regulator due to height restrictions. Moreover, the housing 405 can maintain its height, which provides aeration of water flowing through the insert 401, without requiring housings having different heights when incorporating a throughflow regulator.

As in the embodiment of FIGS. 1-4, due to the arrangement of the throughflow restrictor 403 inside the interior space 406 formed below the upstream sieve 402 an insert unit 401 results with, in reference to conventional insert units, a reduced construction height and/or with the ability to realize a construction height for an insert unit housing a throughflow unit, which previously was only possible for insert units without any throughflow regulators.

It is understood, therefore, that this invention is not limited to the particular embodiments disclosed, but is intended to cover all modifications which are within the spirit and scope of the invention as defined by the appended claims; the above description; and/or shown in the attached drawings.

The invention claimed is:

1. A sanitary insert unit, having an upstream end, a downstream end, and a central axis passing through the upstream end and the downstream end, and configured for insertion into a discharge fitting, the sanitary insert unit comprising:

an upstream conically-shaped sieve;

a throughflow regulator positioned downstream relative to the conically-shaped sieve and comprising a central core region, an exterior edge region comprising a surface facing, and in direct fluid communication with, the conically-shaped sieve, and a control gap radially between the central core region and the exterior edge region;

a jet regulator in throughflowing connection with the control gap and positioned downstream relative to the conically-shaped sieve and the throughflow regulator;

wherein the surface of the exterior edge region of the throughflow regulator facing, and in direct fluid communication with, the conically-shaped sieve comprises a sloping surface rising upward toward the upstream end of the sanitary insert unit and radially inward toward the central axis of the sanitary insert unit;

wherein the sloping surface of the upstream end of the exterior edge region of the throughflow regulator is configured to feed inflowing water from the upstream conically-shaped sieve to the control gap; and wherein the central core region and the exterior edge region of the throughflow regulator are made of one piece and the central core region is radially surrounded by an annular throttle body.

2. The sanitary insert unit according to claim 1, wherein the sloping surface of the throughflow regulator has an end closest to the upstream end of the sanitary insert unit and an end closest to the downstream end of the sanitary insert unit; and wherein the end of the sloping surface of the throughflow regulator closest to the upstream end of the sanitary insert unit is radially closer to the control gap than the end of the sloping surface of the throughflow regulator closest to the downstream end of the sanitary insert unit.

3. The sanitary insert unit according to claim 1, wherein the sloping surface of the throughflow regulator facing, and in direct fluid communication with, the conically-shaped sieve is in throughflowing connection with the control gap.

4. The sanitary insert unit according to claim 3, wherein the sloping surface of the throughflow regulator facing, and in direct fluid communication with, the conically-shaped sieve comprises radially aligned grooves configured to form inflow channels.

5. The sanitary insert unit according to claim 1, wherein the control gap is radially between the annular throttle body and the exterior edge region of the throughflow regulator.

6. A sanitary insert unit, having an upstream end, a downstream end, and a central axis passing through the upstream end and the downstream end, and configured for insertion into a discharge fitting, the sanitary insert unit comprising:

an upstream conically-shaped sieve;

a throughflow regulator positioned downstream relative to the conically-shaped sieve and comprising a central core region, an exterior edge region comprising an upstream end and a downstream end, and an annular control gap radially between the central core region and the exterior edge region;

a jet regulator in throughflowing connection with the control gap and positioned downstream relative to the conically-shaped sieve and the throughflow regulator;

wherein the upstream end of the exterior edge region of the throughflow regulator comprises a sloping surface (i) in fluid communication with the upstream conically-shaped sieve and (ii) rising upward toward the upstream end of the sanitary insert unit and radially inward toward the central axis of the sanitary insert unit; and wherein the sloping surface of the upstream end of the exterior edge region of the throughflow regulator is configured to feed inflowing water from the upstream conically-shaped sieve to the control gap.

7. The sanitary insert unit according to claim 6, wherein the sloping surface of the upstream end of the exterior edge region of the throughflow regulator comprises radially aligned grooves configured to form inflow channels.

8. The sanitary insert unit according to claim 6, wherein the central core region of the throughflow regulator is radially surrounded by an annular throttle body; and wherein the control gap is radially between the annular throttle body and the exterior edge region of the throughflow regulator.

* * * * *